United States Patent [19]

Zaffrann, Jr. et al.

[11] 3,959,615

[45] May 25, 1976

[54] TRIP MECHANISM FOR DISCONNECT SWITCH

[75] Inventors: Albert A. Zaffrann, Jr., Milwaukee; Robert E. Borchardt, Brown Deer; Frank A. Grabarczyk, Milwaukee, all of Wis.

[73] Assignee: Allen-Bradley Company, Milwaukee, Wis.

[22] Filed: Jan. 10, 1975

[21] Appl. No.: 540,119

[52] U.S. Cl. ..... 200/153 H

[51] Int. Cl.[2] ..... H01H 31/00

[58] Field of Search..... 200/153 H, 153 G, 153 R, 200/48 R

[56] References Cited

UNITED STATES PATENTS 2,701,287 2/1955 Winter ..... 200/153 H 3,158,724 11/1964 Emerick et al. ..... 200/153 H

*Primary Examiner*—Herman J. Hohauser

*Attorney, Agent, or Firm*—Quarles & Brady

[57] ABSTRACT

A trip mechanism mounts to either side of a disconnect switch to couple the rotatable crossbar thereon to a manually operable handle. The trip mechanism is symmetrical about a vertical plane with the result that it may be mounted to the disconnect switch for either left hand or right hand operation with little modification. A unique coupling arrangement between the trip mechanism and the manually operable handle facilitates installation and connection of the disconnect switch in enclosures of various types and sizes.

12 Claims, 6 Drawing Figures

Fig. 4
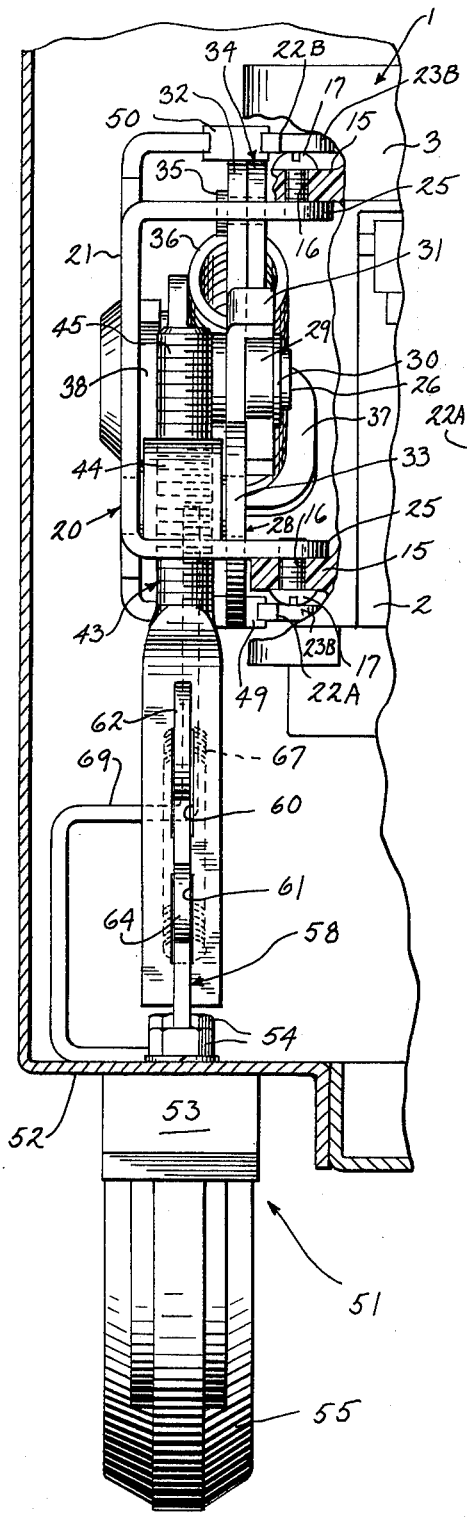
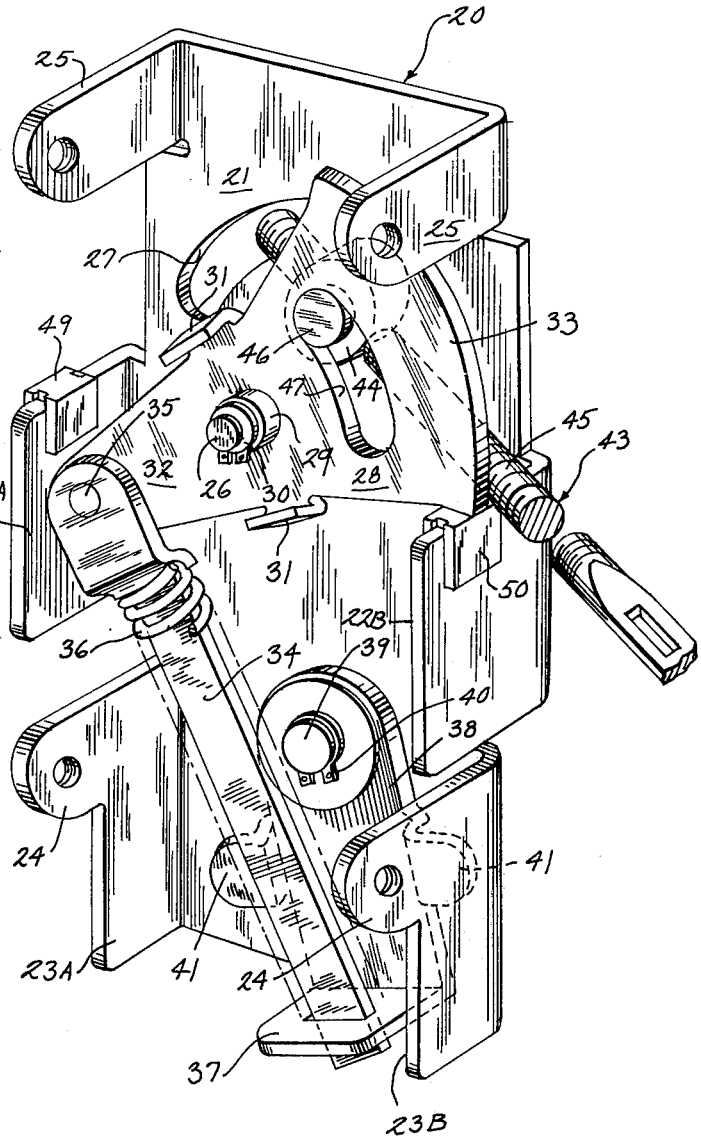
Fig. 5

TRIP MECHANISM FOR DISCONNECT SWITCH

BACKGROUND OF THE INVENTION

The field of the invention is mechanisms for manually operating disconnect switches, and more specifically, spring loaded trip mechanisms for rotating the crossbar on a disconnect switch such as that disclosed in copending patent application Ser. No. 516,388 filed on Oct. 21, 1974, and entitled "Disconnect Switch."

Disconnect switches such as that disclosed in the above cited patent application include a crossbar which is mounted for rotation about a horizontal axis and which carries a set of contacts between an opened and closed position. A trip mechanism couples the crossbar to a manually operable handle which is typically mounted to the front of an enclosure that houses the disconnect switch and associated electrical equipment. The trip mechanism either connects to one end of the crossbar as disclosed, for example, in U.S. Pat. No. 1,918,248, or it may connect to a point intermediate the ends of the crossbar as disclosed, for example, in U.S. Pat. No. 3,602,676.

Prior trip mechanisms are often integral with the particular disconnect switch which they operate and in many cases must be mounted in enclosures having specified dimensions. As a result, there is no flexibility as to where on the enclosure the handle can be mounted and modifications must often be made to the trip mechanism to accommodate different sized enclosures. Also, the coupling of the handle to the trip mechanism on prior structures often involves the connection of many elements and the use of a number of fastening means.

SUMMARY OF THE INVENTION

The present invention resides in a trip mechanism for a disconnect switch that can be coupled to either end of its crossbar and easily connected to the handle which mounts on the front of the switch enclosure. More specifically, the invention includes a frame that is symmetrical about a central plane and includes means for mounting it to either side of the disconnect switch; a drive plate mounted to the frame for rotation about an axis which is within the plane of symmetry and including means for coupling it to the crossbar on the disconnect switch; stop means for limiting the rotation of the drive plate between a first position and a second position; a trip spring having one end connected to the frame at a point that is within the plane of symmetry and a second end which connects to the drive plate at a point which swings equidistantly to each side of the plane of symmetry when the drive plate is rotated between its first and second positions; and means for rotating the drive plate between its first and second positions.

The invention also resides in a means for coupling a manually operable handle to the rotatable drive plate of the trip mechanism. More specifically, a connecting arm pivotally connects to the drive plate and includes a pair of slots which extend transversely therethrough; a drive arm which connects to the handle and is coupled to the connecting arm by a hook member and a guide member which extend through the slots; and a spring which retains the coupling between the connecting arm and the drive arm by generating a retaining force which acts substantially perpendicular to a line which is drawn between the connection of the drive arm and the handle and the connection of the connecting arm and the drive plate.

A general object of the invention is to provide a trip mechanism which can be mounted to either side of the disconnect switch and coupled to its crossbar. Mounting elements are provided on the trip mechanism frame and on each side wall of the disconnect switch. The symmetry of these mounting elements and the operating elements of the trip mechanism allow it to be mounted directly to either side wall without modification. The connecting arm is fastened to extend in the direction of the handle which is mounted to the front wall of the switch enclosure and the handle may thus be mounted to the left hand or the right hand side of the enclosure door.

Another general object of the invention is to provide a trip mechanism which is easily connected to the handle. No fasteners or additional linkages are needed, instead, the hook member and guide member on the drive arm are guided through the transverse openings on the connecting arm and the spring is fastened thereto to retain them in coupling engagement.

A more specific object of the invention is to provide a coupling between the trip mechanism and handle which is adjustable for use with enclosures of various depths. Pivotal connection of the connecting arm to the drive plate is accomplished by a drive bar which includes a threaded opening. The connecting arm includes a threaded shank portion which is first cut to a selected length and is then inserted into the threaded opening in the drive bar to obtain the proper length for coupling with the drive arm.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

BRIEF DESCRIPTION OF THE DRAWINGS

FIG. 4 is a top view of the trip mechanism in FIG. 3, FIG. 5 is a perspective view of the trip mechanism in FIG. 1.

DESCRIPTION OF THE PREFERRED EMBODIMENTS

Figure 1:
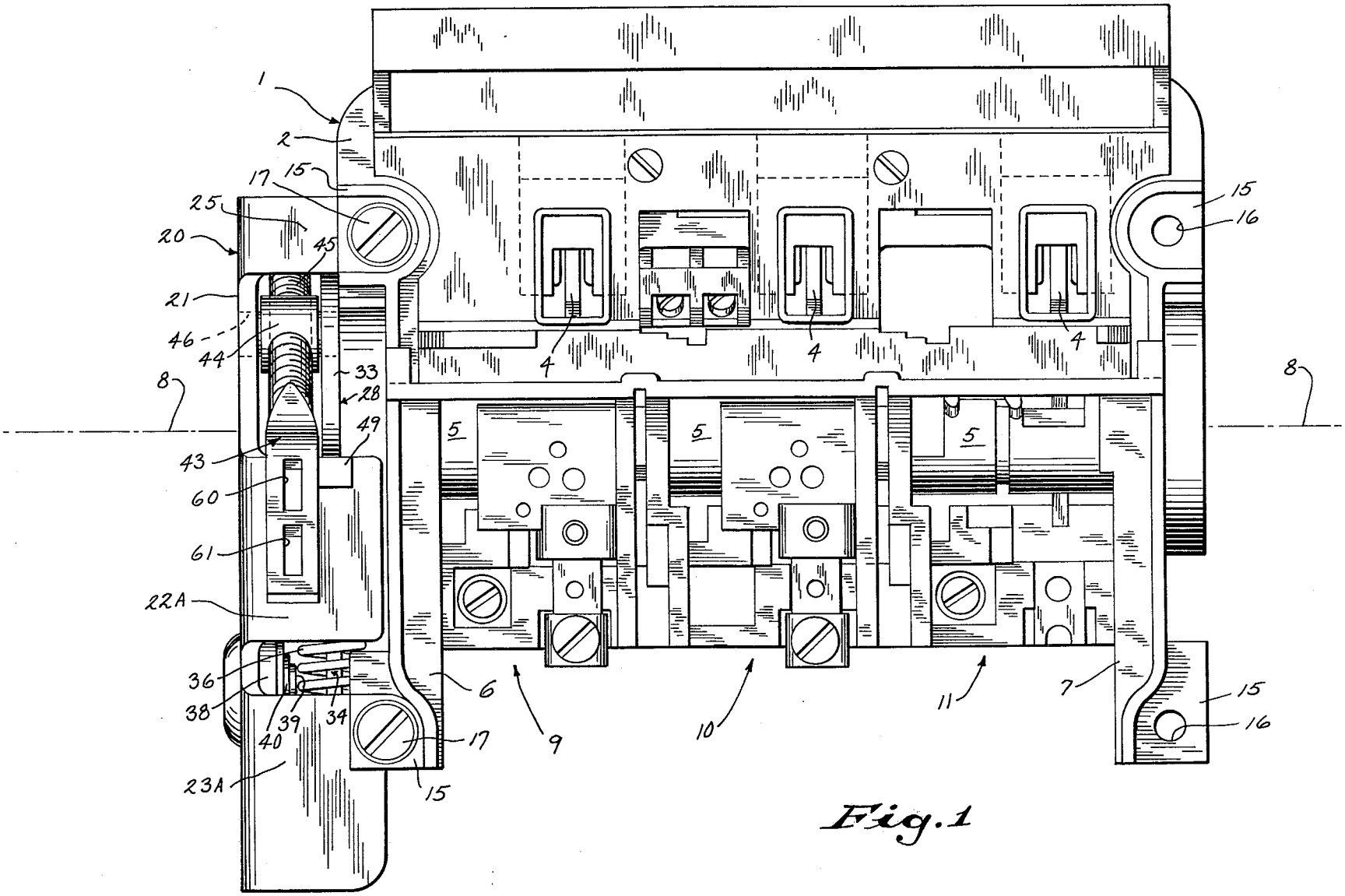
FIG. 1 is a front view of a first preferred embodiment of the invented trip mechanism mounted to the left hand side of a disconnect switch.
Figure 2:
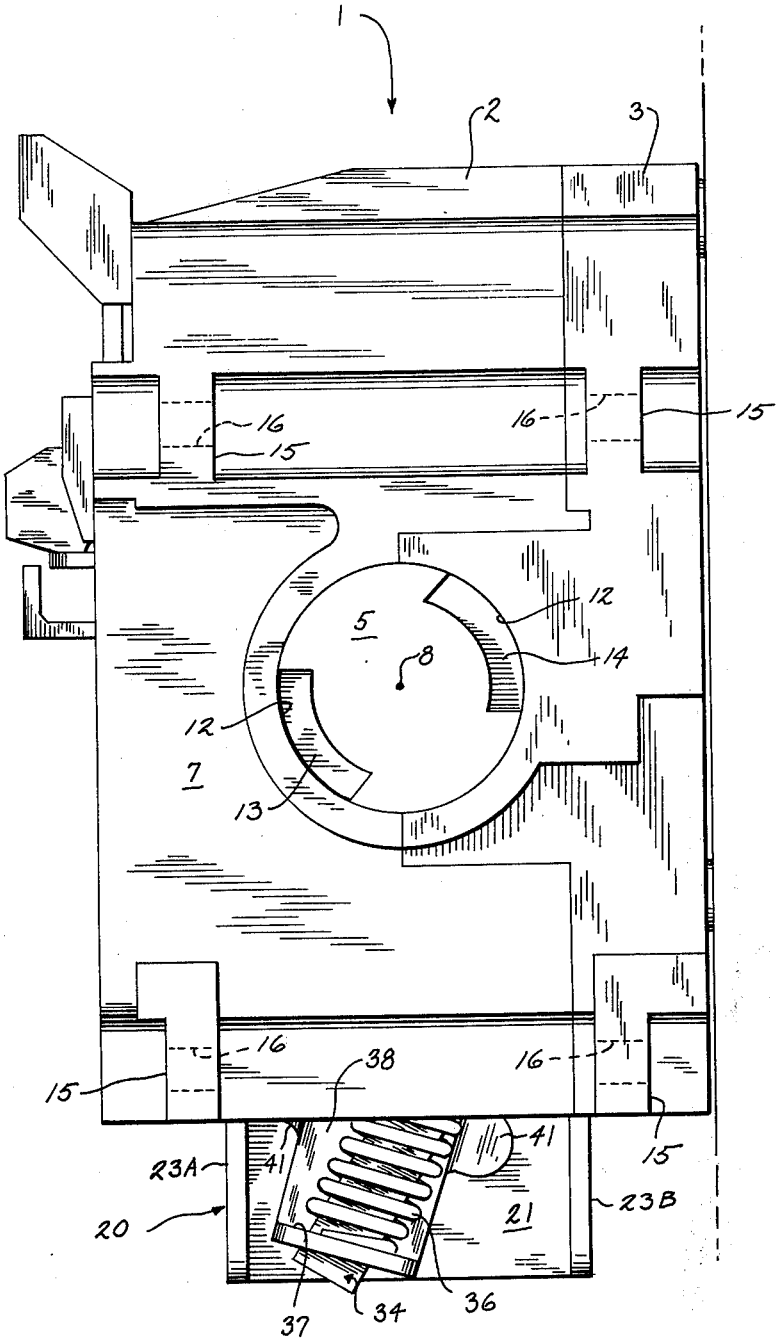
FIG. 2 is a side view of the disconnect switch of FIG. 1.

Referring particularly to FIGS. 1 and 2, the disconnect switch includes a two-part housing 1 which is formed by a base 2 and a back 3 which are molded from an electrically insulating thermoset phenolic material and fastened together by a set of screws (not shown in the drawings). The housing 1 rotatably supports a crossbar 5 which is journaled to a pair of spaced side walls 6 and 7 and which runs transversely through the interior of the housing 1 along a horizontal actuator axis 8. The housing 1 encloses a three-pole, single throw disconnect switch and is divided into three compartments 9, 10 and 11 which each enclose the elements of one pole. The three poles are identical, and each includes a movable contact blade 4 which is fastened to the crossbar 5 and which is pivoted thereby about the actuator axis 8 between an opened and a closed position. The crossbar 5 rotates approximately 55° about the actuator axis 8 to pivot the contact blades between their fully opened position and their closed position in which they make electrical contact with a set of stationary contacts (not shown in the drawings). For a more detailed description of the structure and operation of the disconnect switch, reference is made to the above cited copending patent application.

Referring to FIGS. 1 and 2, the crossbar 5 extends through circular openings 12 in the side walls 6 and 7 and includes integrally molded coupling elements on each of its ends. More specifically, a pair of arcuate recesses 13 and 14 are formed on each end of the crossbar 5 on opposite sides of the actuator axis 8 and each arcuate recess 13 and 14 extends 51° thereabout. A set of four mounting ears 15 are integrally molded to each of the side walls 6 and 7 and openings 16 are formed therein to receive mounting screws 17 that fasten the trip mechanism to the disconnect switch housing 1. The mounting ears 15 on each side wall 6 and 7 are symmetrical about a vertical plane taken through the actuator axis 8 and the mounting ears 15 on the side wall 6 are a mirror image of the mounting ears 15 on the side wall 7. As will become apparent from the description which follows, this symmetry allows the trip mechanism to be mounted on either side wall 6 or 7 where it couples with the exposed end of the crossbar 5.

Figure 3:
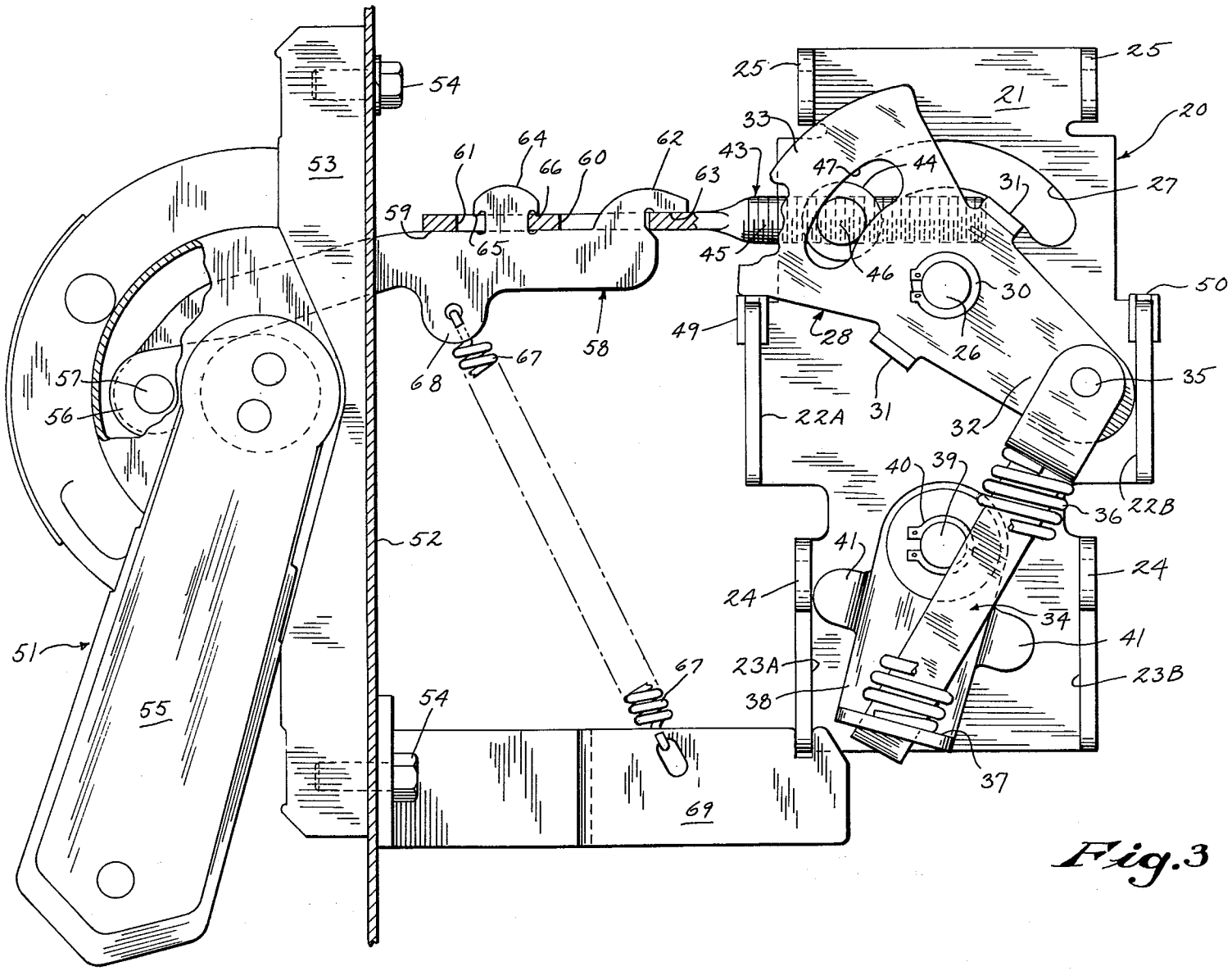
FIG. 3 is a side elevation view of the trip mechanism of FIG. 1 illustrating its connection to a handle mechanism.

Referring to FIGS. 3–5, the first preferred embodiment of the trip mechanism includes a frame 20 which is formed from sheet or steel strip which is 0.125 inches thick. The frame 20 has a back wall 21 which supports the operating elements of the trip mechanism and it has a pair of integrally formed upper sides 22*a* and *b* and a pair of lower sides 23*a* and *b* which extend forward from the back wall 21 along its side boundaries. A pair of lower mounting ears 24 extend forward from the lower sides 23*a* and 23*b*, and a pair of upper mounting ears 25 extend forward from the back wall 21 at its upper boundary. The frame 20 is symmetrical about a vertical plane taken through its center and the mounting ears 24 and 25 are positioned to mate with the mounting ears 15 on either side wall 6 or 7 of the disconnect switch. When thus mounted to the disconnect switch, the actuator axis 8 lies within the plane of symmetry of the trip mechanism frame 20.

Securely fastened to the back wall 21 and extending forward therefrom is a post 26. The center line of the post 26 lies within the plane of symmetry and is coaxial with the actuator axis 8 when the trip mechanism is mounted to the disconnect switch. An arcuate bearing slot 27 is formed through the back wall 21 and is positioned immediately above the post 26. The bearing slot 27 extends concentrically around the guide post 26 approximately 114° and is symmetrical about the plane of symmetry. The post 26 rotatably supports a drive plate 28 which is copper brazed to a hub 29 that surrounds the post 26. A snap ring 30 holds the hub 29 and attached drive plate 28 in place. The drive plate 28 is formed from sheet or steel strip which is 0.125 inches thick and includes a pair of integrally formed coupling elements 31 which extend forward therefrom on opposite sides of the post 26. The coupling elements 31 mate with the arcuate recesses 13 and 14 on the end of the crossbar 5 when the trip mechanism is mounted to the disconnect switch.

The drive plate 28 is elongated and includes an operating end 32 which is disposed to one side of the post 26 and a coupling end 33 which is disposed to the other side. An opening is formed through the operating end 32 of the drive plate 28 and a spring support link 34 is connected thereto by a pin 35. The link 34 has a double bend at its upper end which forms a seat against which the upper end of a trip spring 36 bears. The lower end of the link 34 extends through a slot which is formed in a forward extending bracket portion 37 of a swing plate 38. The top surface of the bracket 37 serves as a lower seat for the trip spring 36 and the trip spring 36 thus generates a bias force which drives the operating end 32 of the drive plate 28 upward and away from the bracket 37.

The bracket 37 is integrally formed to the lower end of the swing plate 38, the upper end of which is rotatably fastened to a post 39 by a snap ring 40. The center line of the post 39 is located within the plane of symmetry and the swing plate 38 swings to either side of that plane in response to the rotation of the drive plate 28. A pair of integrally formed tabs 41 extend outward from each side of the swing plate 38 to act as stops which engage the lower sides 23 and limit the extent to which the swing plate 38 toggles.

The drive plate 28 rotates between a first position and a second position and in so doing rotates the crossbar 5 to operate the movable contact blades 4 on the disconnect switch. The driving force is provided by a connecting arm 43 which is coupled to the drive plate 28 by a drive bar 44. The drive bar 44 is disposed between the back wall 21 and the drive plate 28 and the connecting arm 43 includes a threaded shank portion 45 which extends through a threaded opening in the drive bar 44. A neck portion 46 is formed on the rear and front surfaces of the drive bar 44, and the rear neck portion 46 (not shown in the drawings) rides in the arcuate bearing slot 27 in the back wall 21 and the forward neck portion 46 rides in an arcuate drive slot 47 which is formed through the coupling end 33 of the drive plate 28. The drive slot 47 is concentric about the pin 26 and extends approximately 19° on each side of the center line of drive plate 28.

As is shown in FIGS. 3 and 5, the connecting arm 43 can extend in either direction from the frame 20. The choice depends upon which side of the disconnect switch the trip mechanism is to be mounted. The changeover is made merely by unscrewing the connecting arm 43 from the drive bar 44 and reinserting it from the opposite side. No other changes are required to convert the trip mechanism to either left hand or right hand operation.

The drive plate 28 may rest in a first position shown in FIG. 3 in which its coupling end 33 bears against a plastic cushion 49 that is pressed into the top edge of the upper left hand side wall 22*a*. It may also rest in a second position in which the coupling end 33 bears against a cushion 50 that is pressed into the top edge of the upper right hand side wall 22*b*. Rotation between these two stable positions is obtained by translating the connecting arm 43 rearward such that the neck portion 46 on the drive bar 44 engages the right hand end of the drive slot 47 and rotates the drive plate 28 in a clockwise direction against the force of the trip spring 36. When the pin 35 that connects the drive plate 28 to the spring support link 34 becomes aligned directly between the two posts 26 and 39, the trip spring thrusts the drive plate 28 against the right hand cushion 50. The drive plate 28 is rotated back to its first position in a similar manner by translating the connecting arm 43 forward.

Referring particularly to FIGS. 3 and 4, the trip mechanism is operated by a conventional handle assembly 51 which is mounted to the front wall 52 of the enclosure which houses the disconnect switch. The handle assembly 51 includes a base portion 53 which is fastened to the front wall 52 by a pair of bolts 54 and a handle portion 55 which is pivotally mounted to the base 53. The disconnect switch is operated by manually swinging the handle 55 between a lower, or off, position and an upper, or on, position. When thus operated, the handle 55 swings through an arc of 138° and pivots an operating arm 56 through a similar arc. The operating arm 56 is rigidly fastened to the handle 55 and is connected by a pin 57 to the forward end of a drive arm 58.

The drive arm 58 extends rearward along a substantially horizontal axis and couples with the connecting arm 43 on the trip mechanism. The connecting arm 43 includes a coupling slot 60 which extends vertically therethrough, transverse to its longitudinal axis. A guide slot 61 of slightly shorter length is also formed vertically through the connecting arm 43 and is located forward of the coupling slot 60. A hook member 62 is integrally formed on the end of the drive arm 58 and it extends upward therefrom through the coupling slot 60. A bearing surface 63 formed on the underside of the hook member 62 engages the top surface of the connecting arm 43. A bearing surface 59 is formed on the bottom surface of the connecting arm 43 near its forward end, and as will be described hereinafter, the bearing surfaces 63 and 59 are held in tight engagement to lock the arms 43 and 58 together to provide a rigid arm which connects the handle assembly 51 to the trip mechanism.

An integrally formed guide member 64 is also formed on the drive arm 58 and extends upward therefrom through the guide slot 61 in the connecting arm 43. The guide member 64 includes laterally extending overhang portions 65 and 66 which engage the top surface of the connecting arm 43 when the guide member 64 is not perfectly centered within the slot 61. When the handle 55 is operated, the guide member 64 slides within the guide slot 61 to either side of center and it operates in combination with the hook member 62 to prevent the arms from buckling upwards when force is applied to the handle 55.

Connection between the drive arm 58 and the connecting arm 43 is also insured by a retainer spring 67 which connects to an ear 68 on the drive arm 58. The spring 67 extends downward and connects to a bracket 69 which is fastened to the enclosure front wall 52 by the lower bolt 54. The spring 67 provides a retaining force which acts substantially perpendicular to the longitudinal axis of the drive arm 58 and connecting arm 43. This force maintains the bearing surface 63 on the hook member 62 in tight engagement with the top surface of the connecting arm 43 and the bearing surface 59 in tight engagement with the top surface of the drive arm 58. This retaining force is particularly important when the handle 55 is not being operated and the guide member 64 becomes centered in the guide slot 61. The length of the coupling slot 60 is chosen such that the drive arm 58 cannot be unhooked from the connecting arm 43 without first aligning the guide member 64 precisely in the center of the guide slot 61 and then lifting them against the force of the retainer spring 67.

Figure 6:
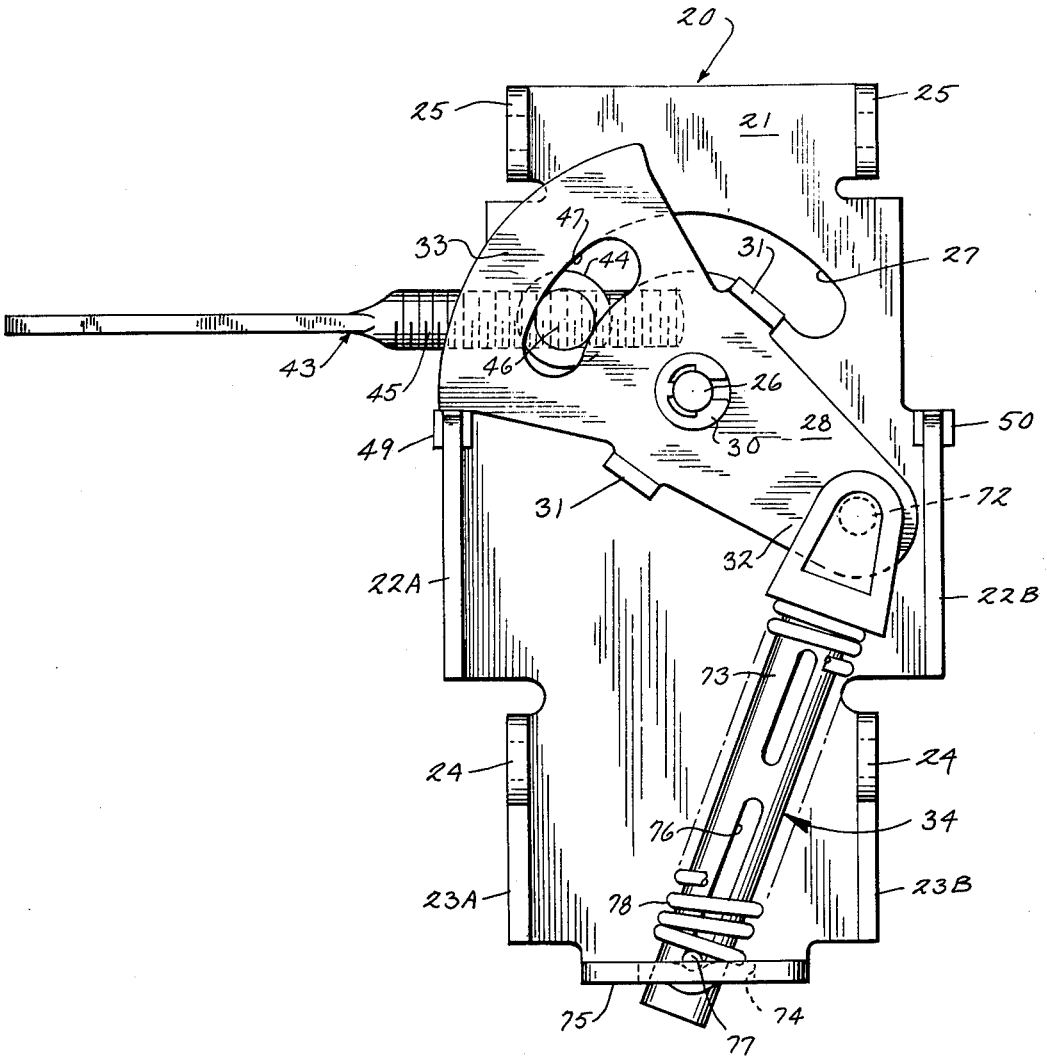
FIG. 6 is a side elevation view of a second preferred embodiment of the invented trip mechanism.

A number of variations can be made in the above-described structure without departing from the spirit of the invention. Referring to FIG. 6, for example, a second embodiment of the trip mechanism is shown in which the lower end of the spring support link 34 is connected directly to the frame 20. The link 34 is molded from a plastic material and its upper end is connected to the drive plate 28 by an integrally molded pin 72. The link 34 includes a circular cylindrical body portion 73 which extends through an opening 74 that is formed in a bracket 75 that is located along the lower boundary of the frame 20. A slot 76 is formed in the body portion 73 and a metal rod 77 extends transversely through this slot 76 and is held tightly against the bracket 75 by the trip spring 78. Indentations are formed in the bracket 75 which retain the rod 77 in the plane of symmetry and the spring support link 34 is thus rotatably connected to the frame 20 at a point which is within the plane of symmetry. The link 34 pivots about this point as the drive plate 28 is rotated between its first and second positions.

We claim:

1. A trip mechanism for rotating the crossbar on a disconnect switch, the combination comprising:

a frame having mounting elements which securely fasten the frame to the disconnect switch;

a drive plate mounted to the frame for rotation about a first axis;

a spring support link having one end pivotally connected to an operating end on said drive plate and a second end connected to the frame for rotation about a second axis which is parallel to said first axis, said first and second axis defining a plane of symmetry;

stop means for limiting the rotational motion of said drive plate between first and second positions and positioned such that the operating end on said drive plate swings through said plane of symmetry and equidistantly to either side thereof when the drive plate rotates between said first and second positions;

a trip spring mounted to said spring support link to provide a bias force which thrusts said drive plate into either of its first or second positions;

a connecting arm coupled to a manually operable handle and pivotally connected to said drive plate to rotate it between its first and second positions when said handle is operated, said pivotal connection being at a point on said drive plate which swings through said plane of symmetry and equidistantly to either side thereof when the drive plate rotates between its first and second positions; and means for coupling the rotation of said drive plate to the crossbar on said disconnect switch.

2. The trip mechanism as recited in claim 1 in which said coupling means includes coupling elements which are integrally formed on said drive plate and positioned concentrically about said first axis of rotation and said mounting elements are symmetrically positioned about said plane of symmetry.

3. The trip mechanism as recited in claim 1 in which the connection of said second end on said spring support link to said frame is made by a swing plate that is rotatably connected to the frame and includes an opening which slidably receives the second end on said spring support link.

4. The trip mechanism as recited in claim 3 in which the frame includes a back wall to which the drive plate and swing plate are rotatably mounted and said opening in the swing plate is formed in a bracket portion which swings through said plane of symmetry and equidistantly to either side thereof as said drive plate is rotated between its first and second positions.

5. The trip mechanism as recited in claim 1 in which said frame includes a back wall to which said drive plate is rotatably mounted and spaced therefrom and a bearing slot is formed through said back wall concentric about said first axis, and in which the pivotal connection of the connecting arm to the drive plate is made by a drive bar which is journaled between said drive plate and the bearing slot in said back wall.

6. The trip mechanism as recited in claim 5 in which the connecting arm includes a threaded shank portion which is received in a threaded opening in said drive bar.

7. The trip mechanism as recited in claim 1 in which the handle is pivotally mounted to an enclosure which houses the disconnect switch and trip mechanism and the handle is coupled to one end of the connecting arm by a drive arm which is translated along a longitudinal axis by the operation of said handle, the drive arm including a hook member which extends through a transverse opening in said connecting arm from one side and bears against the other side of said connecting arm, and a retainer spring connects to the drive arm and the enclosure to provide a bias force which acts substantially perpendicular to said longitudinal axis and which draws said one side of said connecting arm into engagement with said drive arm at a point which is spaced from said transverse opening a substantial distance along said longitudinal axis.

8. The trip mechanism as recited in claim 7 in which a guide member is formed on said drive arm and extends through a guide slot in said connecting arm which is spaced from said transverse opening a substantial distance along said longitudinal axis.

9. The trip mechanism as recited in claim 7 in which said connecting arm includes a threaded shank portion which is received in a threaded opening formed in a drive bar, and in which the drive bar is rotatably fastened to said drive plate.

10. A trip mechanism for a disconnect switch mounted within an enclosure and operable between two operating positions by a handle mechanism, the improvement therein comprising:

a connecting arm fastened to the trip mechanism and extending forward therefrom, said connecting arm including a pair of slots formed through its forward end and disposed along its longitudinal axis; and a drive arm connected to said handle mechanism and extending rearward therefrom into coupling engagement with said connecting arm, said drive arm having a hook member which extends through one of said slots from one side of said connecting arm and engages the opposite side thereof, and a guide member which extends through the other slot from the same side of the connecting arm and includes a pair of laterally extending bearing surfaces which engage the opposite side of said connecting arm when the guide member is translated off center in said slot.

11. The improvement as recited in claim 10 in which a retainer spring connects to one of said arms and provides a downward force which draws the hook member into tight engagement with said other side of the connecting arm.

12. The improvement as recited in claim 10 in which said connecting arm includes a threaded shank portion which is received in a threaded opening in said trip mechanism to provide a means for adjusting the length of the coupling between the handle mechanism and the trip mechanism.

* * * * *